US009963881B1

(12) United States Patent
Aleman et al.

(10) Patent No.: US 9,963,881 B1
(45) Date of Patent: May 8, 2018

(54) GUTTER EXPANSION JOINT

(71) Applicants: Raul Aleman, South Milwaukee, WI (US); Margaret J. Hansen, Waukesha, WI (US)

(72) Inventors: Raul Aleman, South Milwaukee, WI (US); Margaret J. Hansen, Waukesha, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days. days.

(21) Appl. No.: 15/634,378

(22) Filed: Jun. 27, 2017

(51) Int. Cl.
*E04D 13/064* (2006.01)
*E04D 13/068* (2006.01)
*E04D 13/08* (2006.01)

(52) U.S. Cl.
CPC ..... *E04D 13/064* (2013.01); *E04D 13/068* (2013.01); *E04D 13/0645* (2013.01); *E04D 2013/0846* (2013.01)

(58) Field of Classification Search
CPC . E04D 13/064; E04D 13/0645; E04D 13/068; E04D 2013/0846
USPC ..... 248/48.1, 53, 74.3, 74.4
See application file for complete search history.

(56) References Cited

U.S. PATENT DOCUMENTS 2,821,154 A * 1/1958 Tennison, Jr. ..... E04D 13/068 403/300
3,156,099 A * 11/1964 Dailey ..... E02B 13/00 24/DIG. 50
3,545,144 A * 12/1970 Sickler ..... B60P 3/36 248/48.2
3,611,731 A * 10/1971 Edmonson ..... E04D 13/064 405/120
3,670,505 A * 6/1972 Weaver ..... E04D 13/068 405/121
3,913,284 A * 10/1975 Hall ..... E04D 13/0645 405/119
5,038,528 A * 8/1991 Brant ..... E04D 13/068 248/48.1
5,216,852 A * 6/1993 Bemis ..... E04D 13/064 248/48.1
6,634,605 B2 * 10/2003 Bernard ..... H02G 3/0608 248/68.1
2001/0032418 A1 * 10/2001 Richardson ..... E04D 13/064 52/11
2004/0005192 A1 * 1/2004 Chapek ..... E03F 1/002 405/39
2005/0016076 A1 * 1/2005 Spradlin ..... E04D 13/0641 52/11

(Continued)

*Primary Examiner* — Phi D A
(74) *Attorney, Agent, or Firm* — Donald J. Ersler

(57) ABSTRACT

A gutter expansion joint includes a first metal sheet, a second metal sheet and a roof membrane strip. A thermoplastic polyolefin coating is applied to one side of the first and second metal sheets. A first end of the roof membrane strip overlaps the first metal sheet and is secured to the first metal. A second end of the roof membrane strip overlaps the second metal sheet and is secured to the second metal sheet. The first metal sheet, the roof membrane strip and the second metal sheet are bent to be received by an inner perimeter of two adjacent gutters. A bead of non-curing sealant is applied to an inside surface of the two adjacent gutters, before insertion of the gutter expansion joint. A gutter expansion joint cover is attached to an outside perimeter of the two adjacent gutters.

10 Claims, 5 Drawing Sheets

(56) References Cited

U.S. PATENT DOCUMENTS

2012/0066983 A1* 3/2012 Dehart, Sr. ..... E04D 13/0643
52/11

* cited by examiner

GUTTER EXPANSION JOINT

BACKGROUND OF THE INVENTION

1. Field of the Invention

The present invention relates generally to gutters and more specifically to a gutter expansion joint, which is more efficient and less expensive to manufacture than that of the prior art.

2. Discussion of the Prior Art

A portion of a gutter expansion joint must be fabricated from a resilient material, which allows for the expansion and contraction of two adjacent gutter ends. A finished sheet assembly to construct the gutter expansion joint can only be obtained from a country outside the United States. The prior art finished sheet assembly is constructed of a first aluminum sheet, a second aluminum sheet and a strip of neoprene. Both aluminum and neoprene are very expensive materials. A first edge of the neoprene is bonded to the first aluminum sheet and a second edge of the neoprene is bonded to the second aluminum sheet. The finished sheet assembly comes in a roll, which must be uncoiled. However, it is impossible to completely flatten the finished sheet assembly. It is difficult to shear the finished sheet assembly, because it cannot be completely flattened for a metal shear. The finished sheet assembly is bent into a cross-sectional shape of a gutter.

Accordingly, there is a clearly felt need in the art for a gutter expansion joint, which is more efficient and less expensive to manufacture than that of the prior art.

SUMMARY OF THE INVENTION

The present invention provides a gutter expansion joint, which is more efficient and less expensive to manufacture than that of the prior art. The gutter expansion joint includes a first metal sheet, a second metal sheet and a roof membrane strip. A thermoplastic polyolefin coating is applied to one side of the first and second metal sheets. The first and second metal sheets are preferably fabricated from steel sheet with a galvanized metal coating. A first end of the roof membrane strip overlaps the first metal sheet and is secured to the first metal sheet by heating the first metal sheet and the roof membrane strip with hot air or the like. A second end of the roof membrane strip overlaps the second metal sheet and is secured to the second metal sheet by heating the second metal sheet and roof membrane strip with hot air or the like. The first metal sheet, the roof membrane strip and the second metal sheet are bent to be received by an inner perimeter of two adjacent gutters. The cross section of the gutter expansion joint is sized to be received by an inner perimeter of two adjacent gutters. A cross section of the gutter expansion joint preferably includes an inside vertical wall, a horizontal wall, an angled wall, an outside vertical wall and a horizontal inward facing flange. A bead of non-curing sealant is applied to an inside surface of the two adjacent gutters, before insertion of the gutter expansion joint. A gutter expansion joint cover with the same cross sectional elements as the gutter expansion joint is attached to an outside perimeter of the two adjacent gutters.

Accordingly, it is an object of the present invention to provide a gutter expansion joint, which is more efficient and less expensive to manufacture than that of the prior art.

These and additional objects, advantages, features and benefits of the present invention will become apparent from the following specification.

DETAILED DESCRIPTION OF THE PREFERRED EMBODIMENTS

Figure 1:
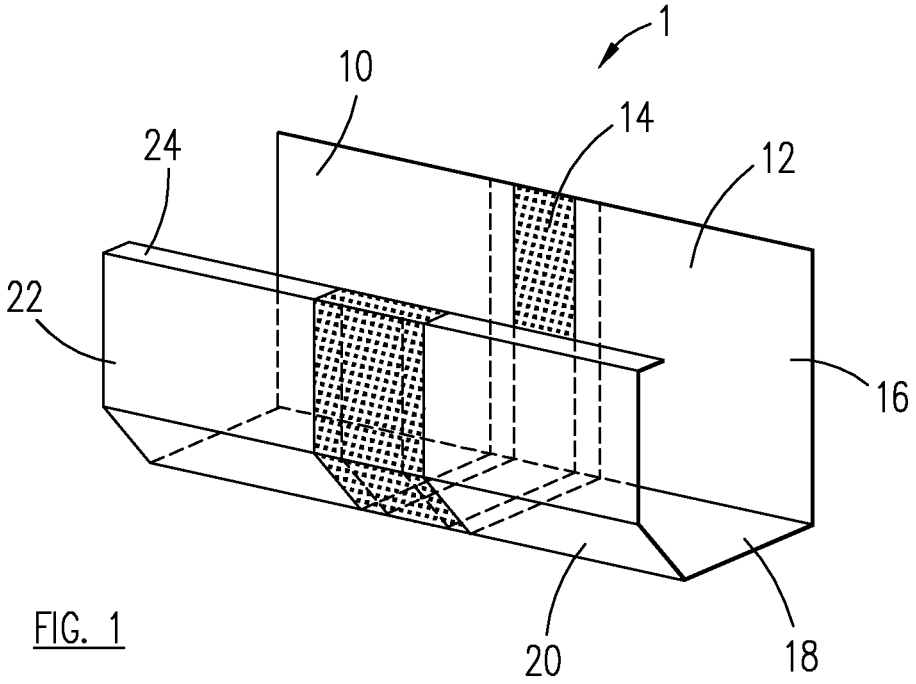
FIG. 1 is a perspective view of a gutter expansion joint in accordance with the present invention.

With reference now to the drawings, and particularly to FIG. 1, there is shown a perspective view of a gutter expansion joint 1. The gutter expansion joint 1 preferably includes a first metal sheet 10, a second metal sheet 12 and a roof membrane strip 14. A thermoplastic polyolefin coating is applied to one side of the first and second metal sheets. The first and second metal sheets 10, 12 are preferably fabricated from steel sheet with a galvanized metal coating. The following dimensions are given by way of example and not by way of limitations. The roof membrane strip 14 is preferably 0.055 inches thick by 6 inches wide and may be obtained at www.gaf.com. However, other thicknesses and widths of roof membrane strip may also be used. However, other manufacturers sell roof membrane strips. The roof membrane strip 14 is preferably fabricated from a thermoplastic polyolefin (TPO). The thermoplastic polyolefin is a blend of thermoplastic; an elastomer or rubber and a filler. The thermoplastic may include polypropylene, polyethylene, block copolymer polypropylene (BCPP) and any other suitable thermoplastic. A first end of the roof membrane strip 14 overlaps the first metal sheet 10 and is secured to the first metal sheet 10 by heating the first metal sheet 10 and the roof membrane strip 14 with hot air or the like. A second end of the roof membrane strip 14 overlaps the second metal sheet 12 and is secured to the second metal sheet 12 by heating the second metal sheet 12 and the roof membrane strip 14 with hot air or the like.

Figure 4:
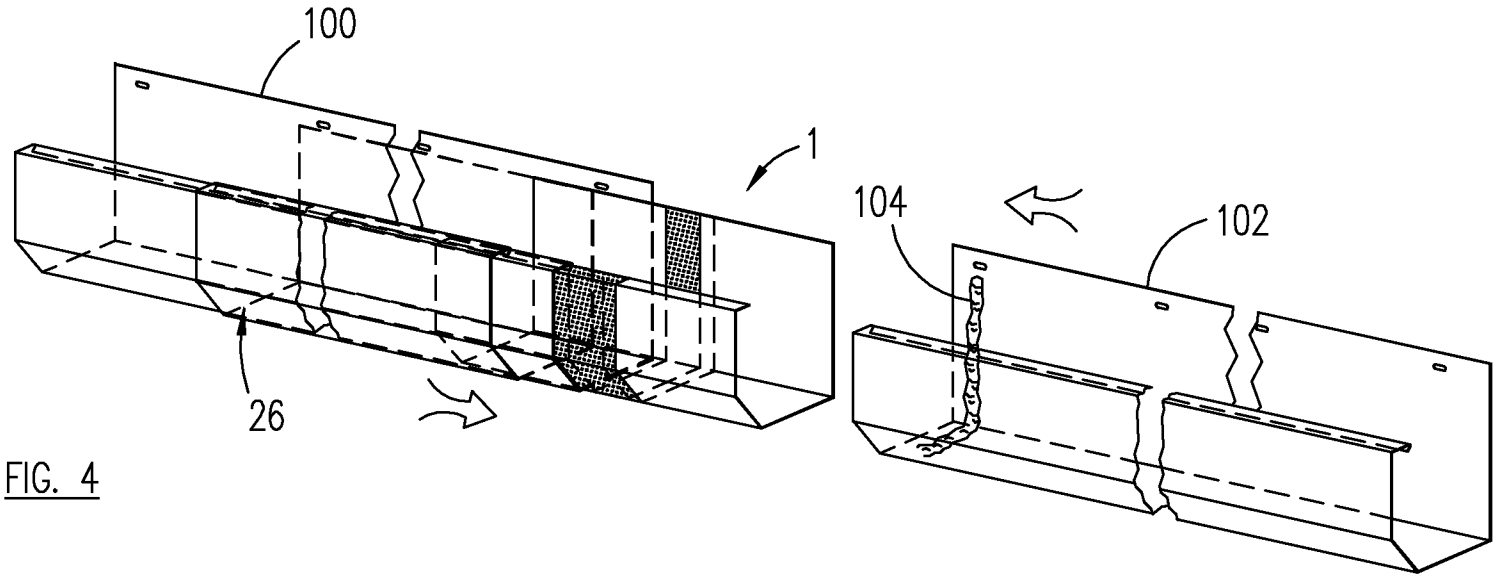
FIG. 4 is a perspective view of a gutter expansion joint after insertion into a first gutter section and before insertion into a second gutter section in accordance with the present invention.

With reference to FIG. 4, the first metal sheet 10, the roof membrane strip 14 and the second metal sheet 12 are then bent to be received by an inner perimeter of a first gutter section 100 and a second gutter section 102. A cross section of the gutter expansion joint 1 is sized to be received by an inner perimeter of the first and second gutter sections 100, 102. The cross section of the gutter expansion joint 1 preferably includes an inside vertical wall 16, a horizontal wall 18, an angled wall 20, an outside vertical wall 22 and a horizontal inward facing flange 24. One end of the horizontal wall 18 extends outward from a bottom of the inside vertical wall 16. One end of the angled wall 20 extends upward from an opposing end of the horizontal wall 18. One end of the outside vertical wall 22 extends from an opposing end of the angled wall 20. The horizontal inward facing flange 24 extends inward from an opposing end of the outside vertical wall 22.

Figure 2:
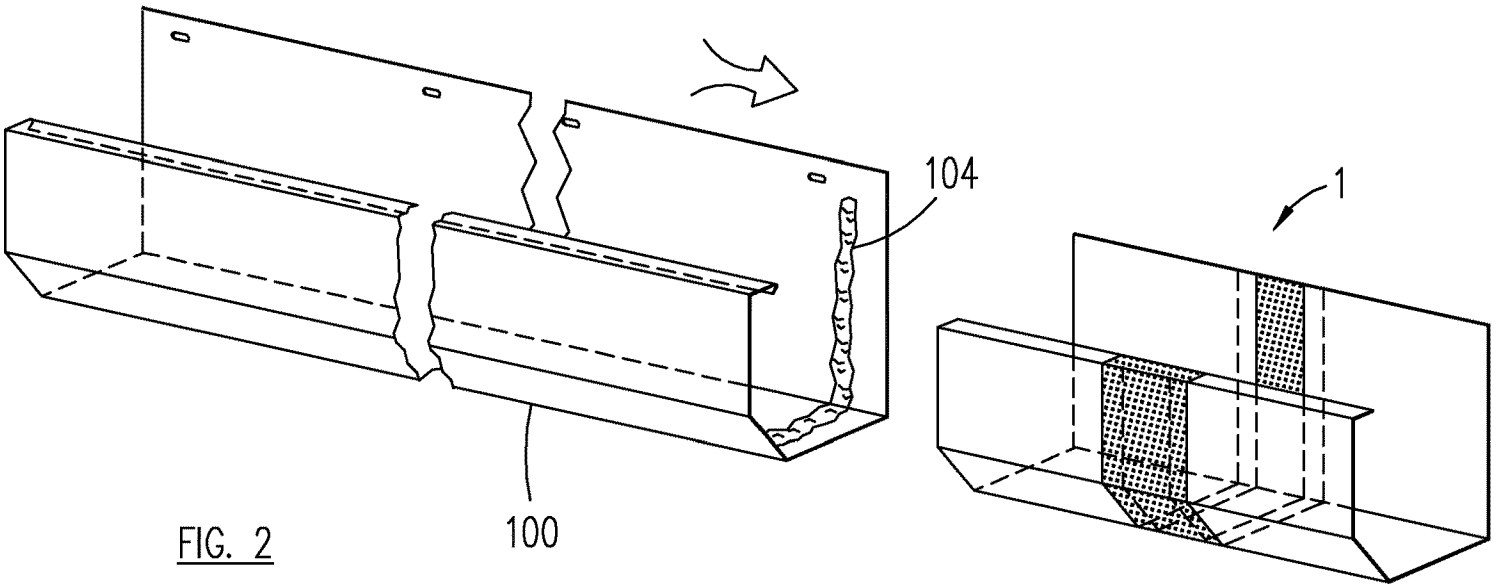
FIG. 2 is a perspective view of a gutter expansion joint before insertion into a first gutter section in accordance with the present invention.
Figure 3:
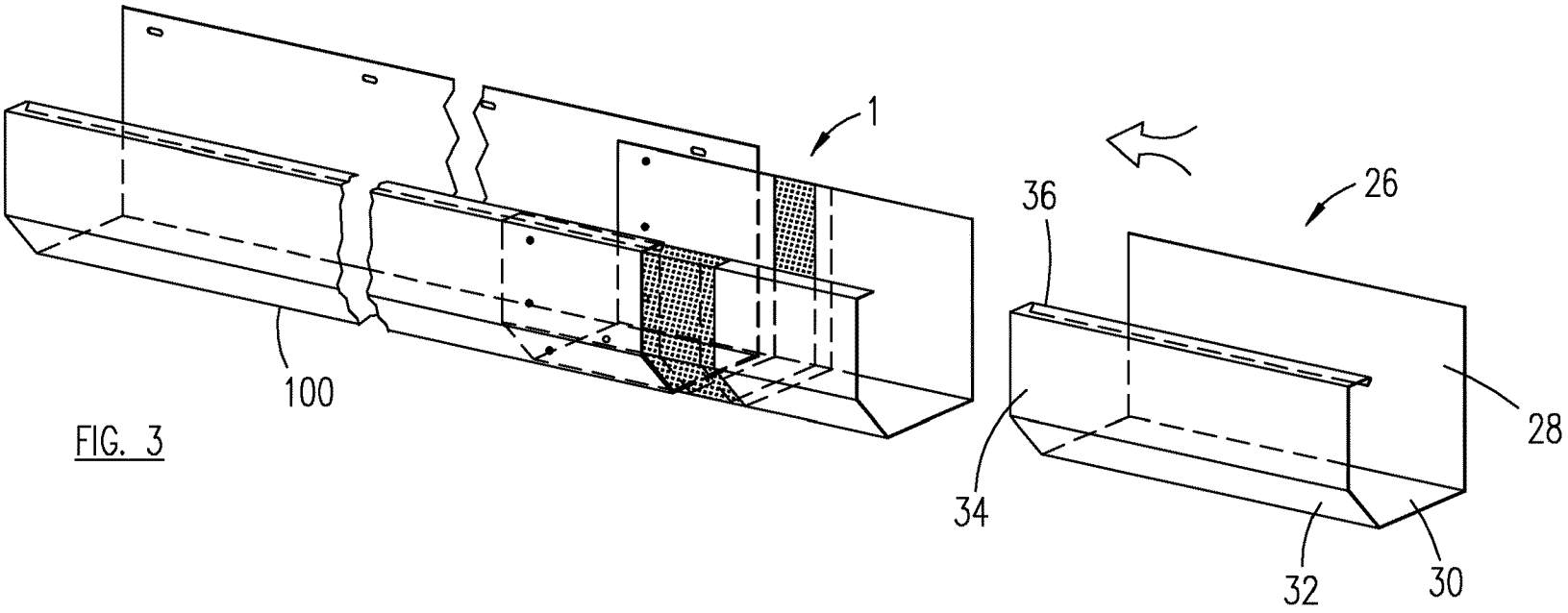
FIG. 3 is a perspective view of a gutter expansion joint after insertion into a first gutter section and illustrating a splice cover in accordance with the present invention.
Figure 5:
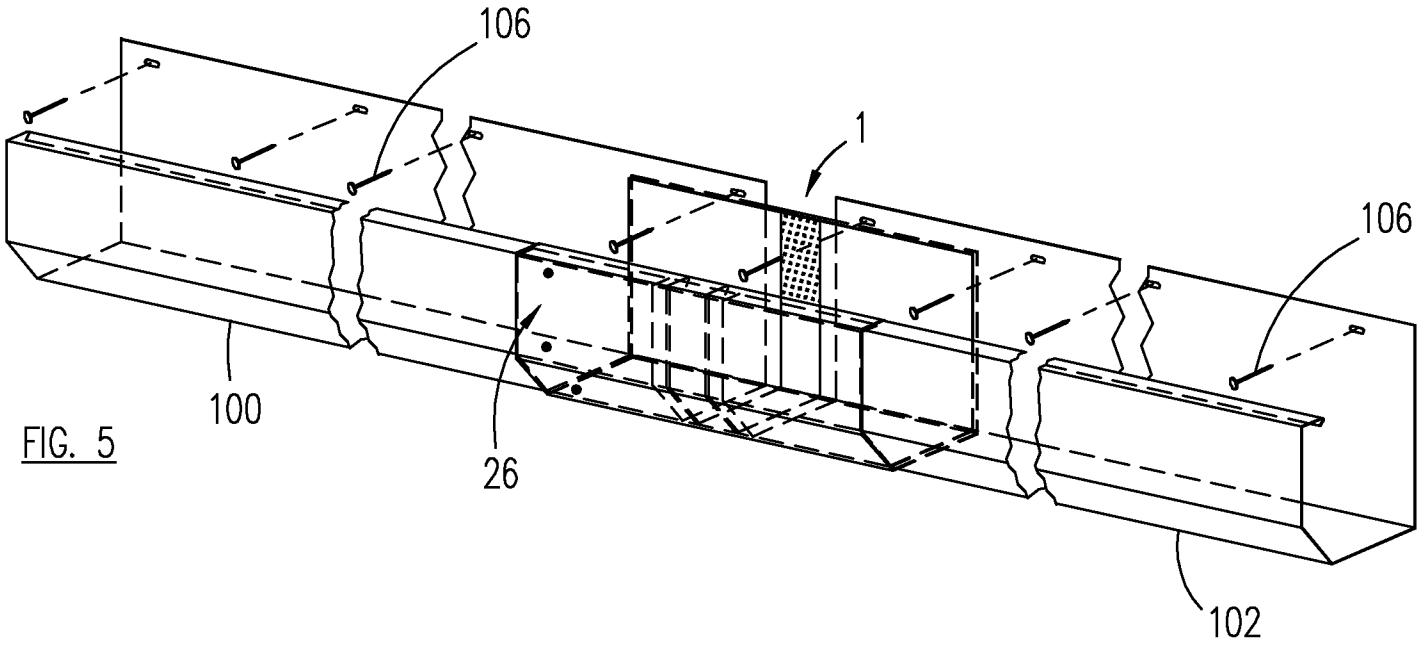
FIG. 5 is a perspective view of a gutter expansion joint with a gutter cover and after installation into first and second gutter sections in accordance with the present invention.

With reference to FIG. 2, a bead of non-curing sealant 104 is applied to an inside surface of the first gutter section 100, before insertion of one end of the gutter expansion joint 1. With reference to FIG. 3, a gutter expansion joint cover 26 includes an inside cover vertical wall 28, a horizontal cover wall 30, a cover angled wall 32, an outside cover vertical wall 34 and a horizontal inward facing cover flange 36. With reference to FIG. 5, an inside perimeter of the gutter expansion joint cover 26 is sized to receive an outside perimeter of the first and second gutter sections 100, 102. With reference to FIG. 4, the gutter expansion joint cover 26 is slid over the first gutter section 100, such that the gutter expansion joint 1 may be inserted into the second gutter section 102. A bead of non-curing sealant 104 is applied to an inside surface of the first gutter section 100, before insertion of an opposing end of the gutter expansion joint 1.

The first and second gutter sections 100, 102 are attached to a fascia of a building with a plurality of fasteners 106. The gutter expansion joint 1 and the gutter expansion joint cover 26 are preferably secured to either the first gutter section 100 or the second gutter section 102 with a plurality of fasteners, such as pop rivets.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method of inserting an expansion joint between a first gutter section and a second gutter section, comprising the steps of:

providing a first metal sheet having a thermoplastic polyolefin coating applied to a first side thereof;

providing a second metal sheet having a thermoplastic polyolefin coating applied to a first side thereof;

providing a roof membrane strip fabricated from a thermoplastic polyolefin material;

overlapping said first metal sheet on said first side with a first portion of said roof membrane strip, overlapping said second metal sheet on said first side with a second portion of said roof membrane strip;

heating a junction of said first metal sheet and said roof membrane strip, such that a bond is formed between said first metal sheet and said roof membrane strip; and heating a junction of said second metal sheet and said roof membrane strip, such that a bond is formed between said second metal sheet and said roof membrane strip to form a gutter expansion joint inserting a first end of the gutter expansion joint into an inner perimeter of the first gutter section, inserting a second end of said gutter expansion joint into the second gutter second.

2. The method of inserting an expansion joint between a first gutter section and a second gutter section of claim 1, further comprising the step of:

utilizing hot air for heating said first metal sheet, said roof membrane strip and said second metal sheet.

3. The method of inserting an expansion joint between a first gutter section and a second gutter section of claim 1, further comprising the step of:

said first and second metal sheets are fabricated from a steel sheet with a galvanized metal coating.

4. The method of inserting an expansion joint between a first gutter section and a second gutter section of claim 1, further comprising the step of providing said gutter expansion joint with an inside vertical wall, a horizontal wall, an angled wall, an outside vertical wall and a horizontal inward facing flange.

5. The method of inserting an expansion joint between a first gutter section and a second gutter section of claim 1, further comprising the step of:

covering the first gutter section, said gutter expansion joint and the second gutter section with a gutter expansion joint cover.

6. A method of inserting an expansion joint between a first gutter section and a second gutter section, comprising the steps of:

providing a first metal sheet having a thermoplastic polyolefin coating applied to a first side thereof;

providing a second metal sheet having a thermoplastic polyolefin coating applied to a first side thereof;

providing a roof membrane strip fabricated from a thermoplastic polyolefin material;

overlapping said first metal sheet on said first side with a first portion of said roof membrane strip, overlapping said second metal sheet on said first side with a second portion of said roof membrane strip;

heating a junction of said first metal sheet and said roof membrane strip, such that a bond is formed between said first metal sheet and said roof membrane strip;

heating a junction of said second metal sheet and said roof membrane strip, such that a bond is formed between said second metal sheet and said roof membrane strip; and bending said first metal sheet, said second metal sheet and said roof membrane strip to have a cross sectional shape which sized to be received by an inner perimeter of the first and second gutter sections to form a gutter expansion joint inserting a first end of said gutter expansion joint into an inner perimeter of the first gutter section, inserting a second end of said gutter expansion joint into the second gutter section.

7. The method of inserting an expansion joint between a first gutter section and a second gutter section of claim 6, further comprising the step of:

utilizing hot air for heating said first metal sheet, said roof membrane strip and said second metal sheet.

8. The method of inserting an expansion joint between a first gutter section and a second gutter section of claim 6, further comprising the step of:

said first and second metal sheets are fabricated from a steel sheet with a galvanized metal coating.

9. The method of inserting an expansion joint between a first gutter section and a second gutter section of claim 6, further comprising the step of:

providing said gutter expansion joint with an inside vertical wall, a horizontal wall, an angled wall, an outside vertical wall and a horizontal inward facing flange.

10. The method of inserting an expansion joint between a first gutter section and a second gutter section of claim 6, further comprising the step of:

covering the first gutter section, said gutter expansion joint and the second gutter section with a gutter expansion joint cover.

* * * * *